US011530575B2

(12) United States Patent
de Jager

(10) Patent No.: US 11,530,575 B2
(45) Date of Patent: Dec. 20, 2022

(54) VIBRATION GENERATOR FOR AN DRILLING INSTALLATION, UNDERWATER DRILLING INSTALLATION AND UNDERWATER DRILLING SYSTEM

(71) Applicant: IHC Marine and Mineral Projects (Proprietary) Limited, Cape Town (ZA)

(72) Inventor: Lourens Christiaan de Jager, Durbanville (ZA)

(73) Assignee: IHC Marine and Mineral Projects (Proprietary) Limited, Cape Town (ZA)

( * ) Notice: Subject to any disclaimer, the term of this patent is extended or adjusted under 35 U.S.C. 154(b) by 1244 days.

(21) Appl. No.: 15/754,594

(22) PCT Filed: Aug. 31, 2015

(86) PCT No.: PCT/ZA2015/050007
§ 371 (c)(1),
(2) Date: Feb. 23, 2018

(87) PCT Pub. No.: WO2017/041118
PCT Pub. Date: Mar. 9, 2017

(65) Prior Publication Data

US 2018/0283104 A1 Oct. 4, 2018

(51) Int. Cl.
*E21B 7/24* (2006.01)
*E21B 7/124* (2006.01)

(52) U.S. Cl.
CPC ..... *E21B 7/24* (2013.01); *E21B 7/124* (2013.01)

(58) Field of Classification Search
CPC ..... E21B 7/24; E21B 7/124
See application file for complete search history.

(56) References Cited

U.S. PATENT DOCUMENTS 3,118,417 A * 1/1964 Stanwick ..... E21B 41/10 114/295
3,194,326 A * 7/1965 Bodine, Jr. ..... E21B 7/124 175/56
3,199,614 A * 8/1965 Bodine, Jr. ..... E02D 7/18 175/19
3,353,612 A * 11/1967 Bannister ..... E21B 49/06 175/6
3,530,947 A * 9/1970 Gendron ..... E02D 15/04 405/249

(Continued)

FOREIGN PATENT DOCUMENTS

WO 2008118314 A1 10/2008

*Primary Examiner* — Aaron L Lembo
(74) *Attorney, Agent, or Firm* — N.V. Nederlandsch Octrooibureau

(57) ABSTRACT

A vibration generator (9) for a drilling installation comprises a housing (16), at least one rotation body (17), a suspension (24) by means of which the rotation body is suspended rotatably within the housing, the mass centre of the rotation body (17) being eccentric with respect to the rotation axis of the suspension, and a drive (18) for rotating the rotation body. The housing (16) holds a fluid (15) which is in contact with the rotation body (17) whereby relative rotation between the rotation body and the fluid generates a flow resistance and in that the rotation body comprises flow resistance reduction means (25).

16 Claims, 4 Drawing Sheets

(56) References Cited

U.S. PATENT DOCUMENTS 3,693,730 A * 9/1972 Edigarian ..... E21B 7/24 175/6
3,714,996 A * 2/1973 Dane, Jr. ..... E21B 25/18 175/6
3,786,874 A 1/1974 Jodet et al.
4,060,138 A 11/1977 Cox et al.
4,265,129 A 5/1981 Bodine
4,527,637 A 7/1985 Bodine
5,456,325 A * 10/1995 Pantermuehl ..... B23B 31/16162 175/55
5,771,985 A * 6/1998 Jaworski ..... E02D 1/025 173/49
6,196,333 B1 * 3/2001 Aardal ..... E21B 7/124 175/5
7,036,598 B2 * 5/2006 Skjærseth ..... E21B 7/124 166/339
7,584,796 B2 * 9/2009 Ayling ..... E21B 7/124 166/358
7,600,570 B2 * 10/2009 Haughom ..... E21B 7/124 166/358
7,703,534 B2 * 4/2010 Sheshtawy ..... E21B 15/02 166/358
8,186,294 B2 * 5/2012 Baylot ..... B63C 7/006 114/221 A
8,596,929 B2 * 12/2013 Hughes ..... F16C 15/00 405/302.4
8,757,289 B2 * 6/2014 Bauer ..... E02D 13/04 175/6
8,997,889 B2 * 4/2015 Finkenzeller ..... E02D 27/52 175/7
9,045,957 B2 * 6/2015 Yajure ..... E21B 31/005
2007/0151377 A1 7/2007 Roussy
2009/0178848 A1 * 7/2009 Nellessen, Jr. ..... E21B 19/08 175/7
2009/0255728 A1 * 10/2009 Spencer ..... E21B 7/124 175/5
2016/0003011 A1 * 1/2016 Shafer ..... E21B 41/0007 166/344
2018/0355674 A1 * 12/2018 Cooper ..... E21B 7/124

* cited by examiner

VIBRATION GENERATOR FOR AN DRILLING INSTALLATION, UNDERWATER DRILLING INSTALLATION AND UNDERWATER DRILLING SYSTEM

The invention is related to a vibration generator for a drilling installation, said generator comprising a housing, at least one rotation body, a suspension by means of which the rotation body is suspended rotatably within the housing, the mass centre of the rotation body being eccentric with respect to the rotation axis of the suspension, and a drive for rotating the rotation body.

Such drilling installation is used to assemble a drill string from drill pipes which are held in a storage. The lowermost drill pipe is provided with a drill bit, so as to gradually make a borehole upon rotating the drill string. Dependent on the nature of the soil material, the drill string advances at a certain rate. With the aim of increasing the penetration rate of the drill string, a vibration generator is applied. During rotation of the drill string, the vibration generator is set in motion, whereby the effectiveness of the drill bit is increased and the drill string advances at a higher speed.

Various proposals for such a vibration generator have been made, for instance in U.S. Pat. No. 4,527,637. This prior art vibration generator has an eccentric mass which is rotated within the housing of the generator. As long as the drill bit is operated under normal conditions on land, the vibration generator performs satisfactorily. However, in the case of subsea drilling operations, the housing is to be compensated for the outside pressure of the water body. For this reason, the housing of the generator has to be completely filled with a fluid such as oil.

In the process of driving the fully submerged rotating body through the oil, a large amount of energy is consumed. After all, the eccentric shape of the rotating body generates a high resistance with respect to the oil fill of the housing. The object of the invention is therefore to provide a vibration generator which is in particular suited for subsea applications. This object is achieved in that the housing holds a fluid which is in contact with the rotation body whereby relative rotation between the rotation body and the fluid generates a flow resistance and in that the rotation body comprises flow resistance reduction means.

Upon rotating the rotating body, it is still subjected to the influence of the oil fill in the housing; however the flow resistance reduction means enables a smooth displacement through the oil while avoiding the occurrence of pressure increase in the oil and/or friction resistance with respect to the oil fill. In hydrodynamics, the design of such flow resistance limiting shapes is well-known. In particular, the rotation body comprises at least one edge facing in a forward rotational direction, said at least one edge may be provided with said flow resistance reduction means. Also or alternatively, the opposite edge of the rotation body, facing away from the forward rotational direction, may be provided with flow resistance reduction means.

According to a preferred embodiment, the rotation body may have a circumference the contour of which is completely positioned between two circles which are concentric with respect to the rotation axis, wherein the difference between the radii of said circles is at least an order of magnitude smaller than one of said radii. Such an embodiment closely resembles a circular circumference, although this need not be a perfect circle. Still, a substantial reduction of the flow resistance may be obtained by means of such somewhat non-circular contour, which may for instance have a wave shape inscribed between the two concentric circles which are closely positioned next to each other as a result of the order of magnitude similarity thereof.

Good results are obtained in case all radial sections of the rotation body have a generally equal shape. In particular, the circumference of the rotation body may be fully circular.

According to a preferred embodiment, the rotation body may comprise at least two materials having different specific masses. Despite the geometric circumferential symmetry of the rotating body, still vibrations may be generated upon rotation of the rotation body. Furthermore, the rotation body may comprise a part having an asymmetrically positioned chamber, and a second part accommodated within the chamber, the specific mass of said second part being higher than the specific mass of the first part. The second rotation body part is preferable positioned with a snugly fit within said chamber of the first rotation body part. In particular, in case a disc shaped rotation body is applied, the opposite surfaces which face away from each other in an axial direction are thus completely smooth or flat, whereby the flow resistance is further reduced.

The invention is furthermore related to an underwater drilling installation, comprising a platform provided with support means for placement on the bottom of a body of water, and a drilling device for performing drilling operations in the bottom, said drilling device being provided with a vibration generator as described before.

Also, the invention is related to an underwater drilling system, comprising a floating barge, lifting means supported on the barge and such underwater drilling installation suspended from the lifting means for lowering the underwater drilling installation on the bottom of a body of water respectively for retrieving the underwater drilling installation from said bottom.

The rotation axis of the suspension is oriented transverse, preferably perpendicular, with respect to the rotation axis of the drilling device. Thereby a sinusoidal force is generated in the longitudinal direction of the drill string, causing said drill string to resonate for increased penetration at relatively low power input.

The invention will now be described further with respect to the embodiment shown in the drawings.

Figure 1:
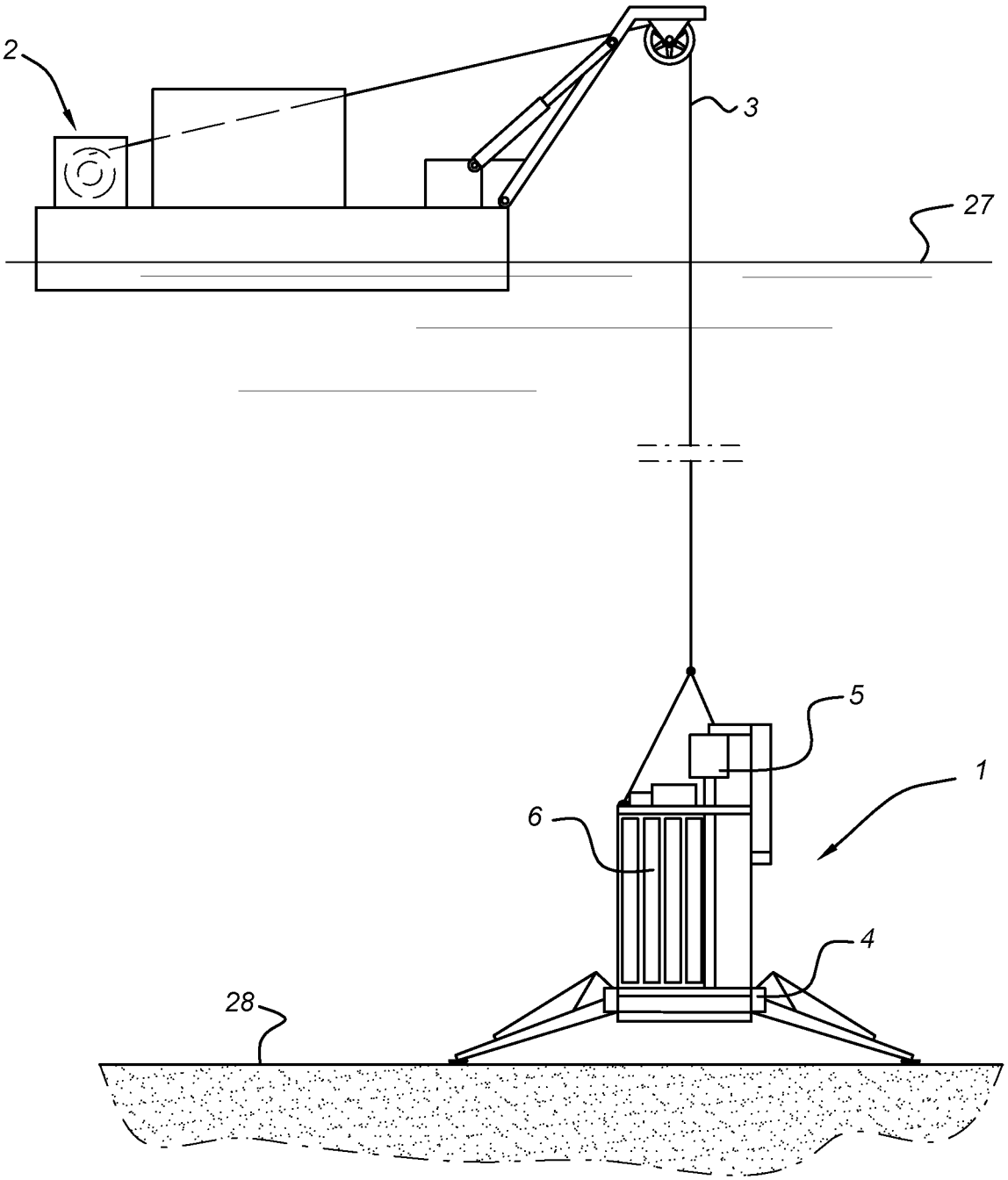
FIG. 1 shows an underwater drilling system.

The underwater drilling system shown in FIG. 1 consists of the underwater drilling installation 1 and the vessel or barge 2 from which the underwater drilling installation is suspended through the hoisting means 3. The barge is floating in a body of water 27, and in the situation shown, the underwater drilling installation is supported on the bottom 28 thereof. In this position, the underwater drilling installation 1 is fit for performing drilling operations in the bottom.

Figure 2:
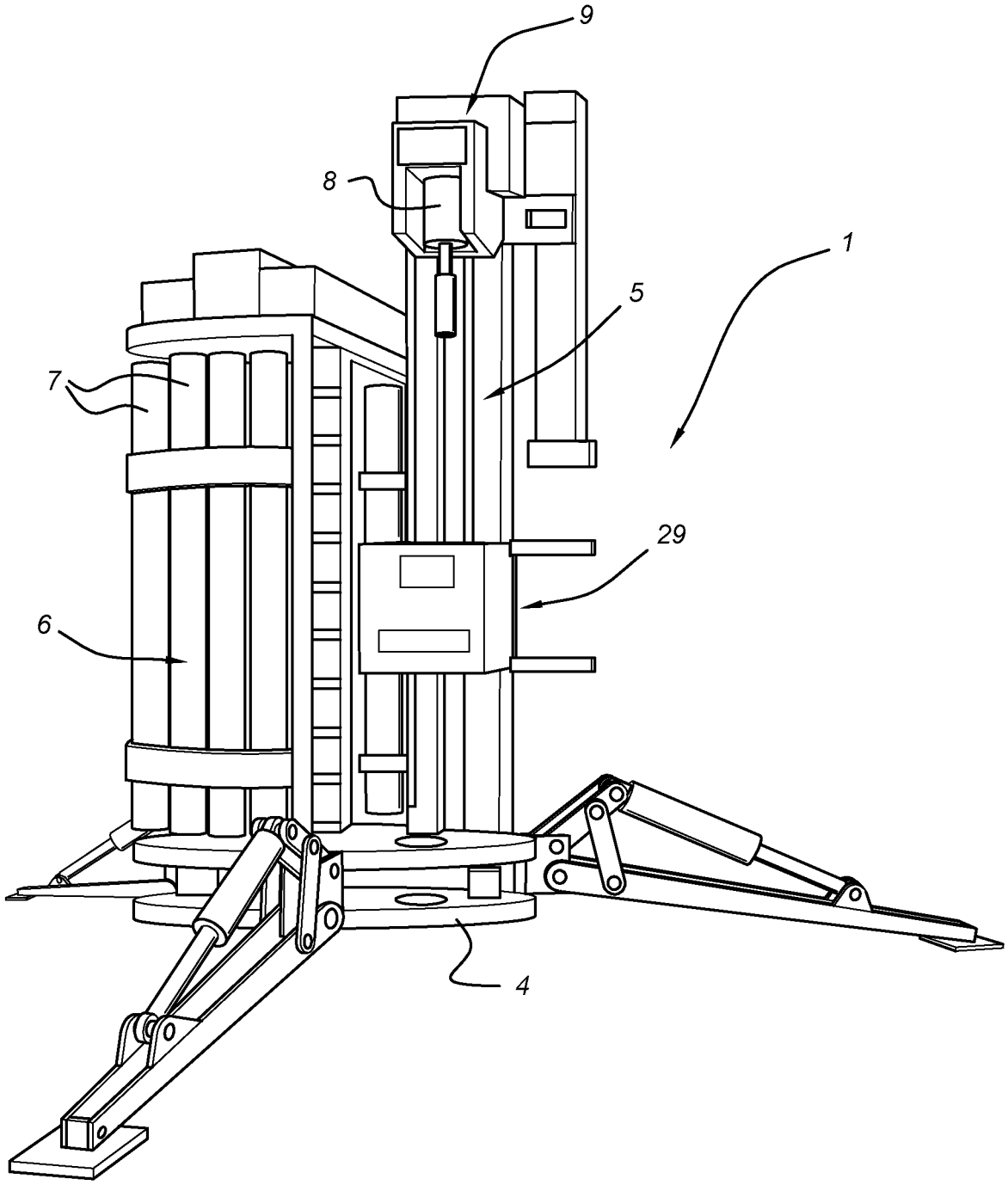
FIG. 2 shows an underwater drilling installation.

To that end, the underwater drilling installation (see FIG. 2) has a base frame 4, supporting the actual drilling rig 5, a carrousel storage 6 which carries a number of drill pipes 6 and a robot 29. In the situation shown in figures a 1 and 2, the underwater drilling installation 1 is idle. In operation, by means of a robot 29, the drill pipes 7 are successively removed from the carrousel storage 6 and connected to each other so as to form the drill string 10. This is carried out in an automated way which is known per se. At the bottom end of the drill string, a drill bit is connected.

As is known, by rotating the drill string through the drill string drive means 8 of the drill rig 5, a bottom hole is formed. As is further known, this operation may be enhanced by generating a vibration in the drill string. Such vibrations may be obtained from the vibration generator 9 which is mounted to the drive means 8. A view of the interior of the drill string drive means 8 and the vibration generator 9 is shown in FIG. 3.

Figure 3:
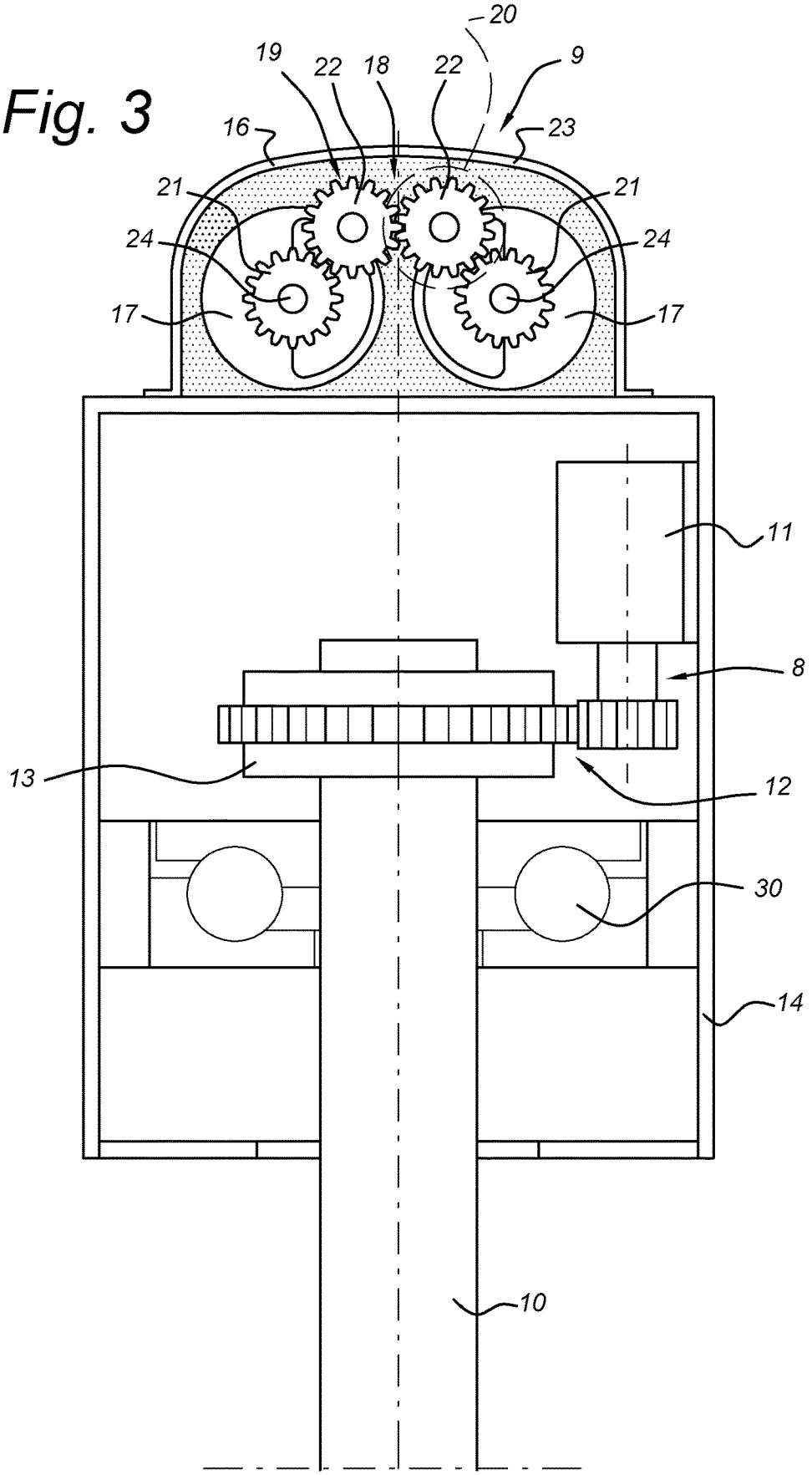
FIG. 3 shows a longitudinal section through the vibration generator.

As shown in FIG. 3, the drive means consists of the electric or hydraulic motor 11, which through a gear set 12 is drivingly connected to the clamp head 13. In the clamp head 13, the drill string 10 is held and rotatably supported by means of the thrust bearing 30. The drive means has a compartment 14 in which these components have been accommodated. Onto the compartment 14, the vibration generator 9 is rigidly mounted.

Figure 4:
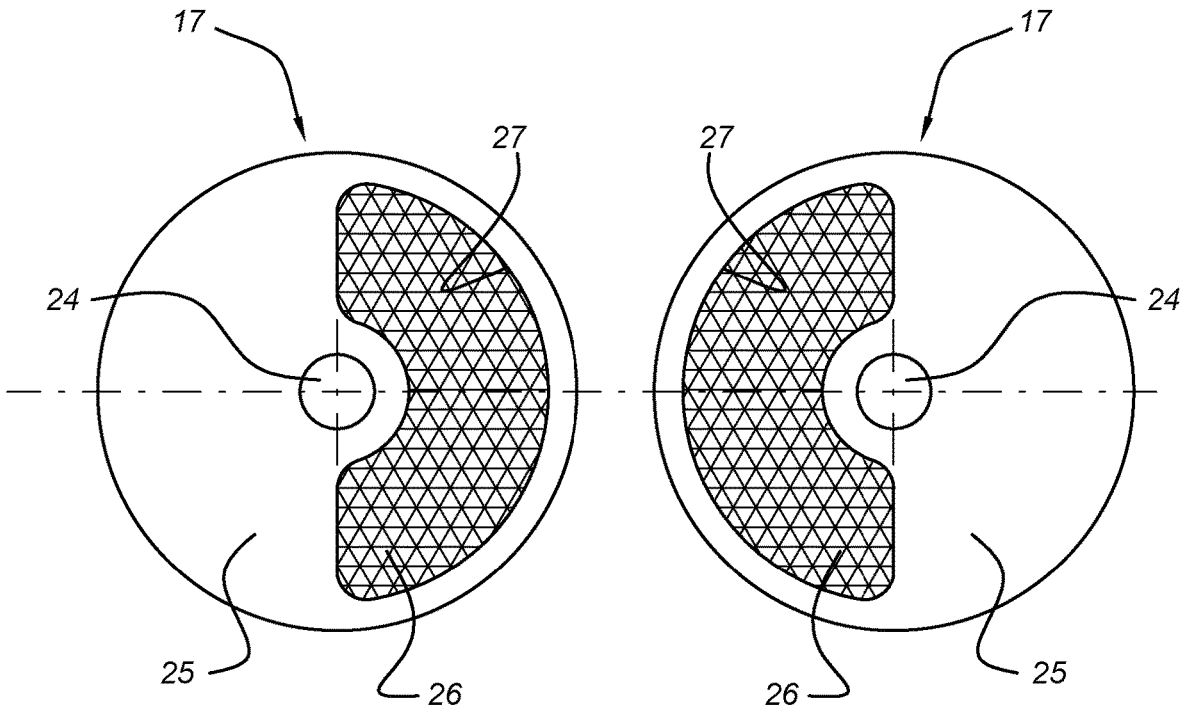
FIG. 4 shows an enlarged view of the rotation bodies.

The vibration generator 9 consists of a housing 16 mounted to the compartment 14, which houses two disc-shaped rotation bodies 17 and a rotation body drive means 18. These rotation body drive means 18 consist of a gear set 19 and the electric or hydraulic motor 20. The gear set 19 of the rotation body drive means 18 has a gear 21 mounted to each of the rotation bodies 17, and an intermediate gear 22 camming which each of the gears 21 and connected to the motor 20. Thus, by energizing the motor 20, the rotation bodies 17 are rotated in opposite directions and at the same speed. In the view of FIG. 4, the rotation bodies 17 are shown in isolation, and in the same view as shown in FIG. 3.

As the drilling installation is operating under water, care should be taken to avoid the surrounding water penetrating the housing 16 of the vibration generator. To that end, the internal space 15 of the housing 16 is completely filled with a fluid such as oil. Thus, the rotation bodies 17 as well as the drive means 18 thereof are fully operated in an oil bath. As will be clear, the oil fill will exert a flow resistance onto the rotation elements, and in particular onto the rotation bodies which as a result of their function usually have an eccentric shape.

With the aim of restricting this flow resistance as much as possible, the rotation bodies are preferably carried out according to the embodiment shown in FIG. 4. Each rotation body 17 is mounted on a shaft 24 which also carries the gear 21. The rotation bodies each consists of a first rotation body part 25 having a fully circular circumference as well as a chamber 27 which is about kidney-shaped. Within the kidney-shaped chamber 27, a correspondingly shaped second rotation body part 26 has been fitted. As shown in FIG. 3, the second rotation body part 26 snugly fits within the corresponding chamber 27 of the first rotation body part 25.

By selecting a different specific masses for the first and second rotation body parts 25, 26, an imbalance is obtained. Thus, upon rotation of the rotation bodies, vibrations are generated in the longitudinal direction of the drill string 10. On the other hand, as a result of the completely circular circumference of the rotation bodies, and the snugly fit of the second rotation body part 26 in the first rotation body part 25, only a low flow resistance is experienced by the rotation bodies while they are rotated with respect to the oil fill within the housing 16.

LIST OF REFERENCE NUMERALS

1. Underwater drilling installation
2. Barge
3. Hoisting means
4. Base frame
5. Drilling rig
6. Storage carrousel
7. Drill pipe
8. Drill string drive means
9. Vibration generator
10. Drill string
11. Motor drive means
12. Gear set
13. Clamp head
14. Compartment drive means
15. Internal space
16. Housing vibration generator
17. Rotation body
18. Drive means vibration generator
19. Gear set vibration generator
20. Motor vibration generator
21. Gear
22. Gear
23. Fluid fill
24. Shaft rotation body
25. First rotation body part
26. Second rotation body part
27. Body of water
28. Bottom
29. Robot
30. Thrust bearing

The invention claimed is:

1. A vibration generator for a drilling installation, said generator comprising a housing, at least one rotation body, a suspension by means of which the rotation body is suspended rotatably within the housing, the mass centre of the rotation body being eccentric with respect to the rotation axis of the suspension, and a drive for rotating the rotation body, wherein the housing holds a fluid which is in contact with the rotation body whereby relative rotation between the rotation body and the fluid generates a flow resistance and in that the rotation body comprises flow resistance reduction means; and wherein the circumference of the rotation body is fully circular, wherein the rotation body comprises at least one edge oriented transversely with respect to the rotational direction, said at least one edge being provided with said flow resistance reduction means.

2. The generator according to claim 1, wherein the rotation body has a circumference the contour of which is completely positioned between two circles which are concentric with respect to the rotation axis.

3. The generator according to claim 1, wherein all radial sections of the rotation body have a generally equal shape.

4. The generator according to claim 1, wherein the rotation body comprises at least two materials having different specific masses.

5. The generator according to claim 1, wherein the rotation body comprises a rotation body part having an asymmetrically positioned chamber, and a second rotation body part accommodated within the chamber, the specific mass of said second rotation body part being different from the specific mass of the first rotation body part.

6. The generator according to claim 5, wherein the second rotation body part snugly fits within the chamber of the first rotation body part.

7. The generator according to claim 1, wherein the rotation body is disc-shaped.

8. The generator according to claim 1, wherein the rotation body is submerged in the fluid.

9. The generator according to claim 1, wherein the housing is completely filled with the fluid.

10. The generator according to claim 1, comprising two identical rotation bodies, wherein the drive synchronously rotates said rotation bodies in opposite directions.

11. An underwater drilling installation, comprising a platform provided with support means for placement on the bottom of a body of water, and a drilling device for performing drilling operations in the bottom, said drilling device being provided with a vibration generator according to claim 1.

12. The underwater drilling installation according to claim 11, comprising a storage for drill pipes and a robot for transferring the drill pipes from the storage to the drilling device and for assembling the drill pipes into a drill string and vice versa.

13. An underwater drilling system, comprising a floating vessel, hoisting means supported on a barge and an underwater drilling installation according to claim 11 suspended from the hoisting means for lowering the underwater drilling installation on the bottom of a body of water respectively for retrieving the underwater drilling installation from said bottom.

14. The underwater drilling system according to claim 11, wherein a rotation axis of the suspension is oriented transverse, with respect to the rotation axis of the drilling device.

15. The underwater drilling system of claim 14, wherein the rotation axis of the suspension is oriented perpendicular with respect to the rotation axis of the drilling device.

16. The generator according to claim 1, wherein the fluid is oil.

* * * * *